United States Patent [19]

Hartman

[11] 4,427,235

[45] Jan. 24, 1984

[54] METHOD OF SOLUTION MINING SUBSURFACE OREBODIES TO REDUCE RESTORATION ACTIVITIES

[75] Inventor: George J. Hartman, Casper, Wyo.

[73] Assignee: Ogle Petroleum Inc. of California, Casper, Wyo.

[21] Appl. No.: 226,122

[22] Filed: Jan. 19, 1981

[51] Int. Cl.[3] ..... E21B 43/28

[52] U.S. Cl. ..... 299/5

[58] Field of Search ..... 299/4, 5

[56] References Cited

U.S. PATENT DOCUMENTS

| | | | |
|---|---|---|---|
| 2,738,253 | 3/1956 | Thunaes et al. | 23/14.5 |
| 2,818,240 | 12/1957 | Livingstone | 299/5 |
| 3,309,140 | 3/1967 | Gardner et al. | 299/4 |
| 3,309,141 | 3/1967 | Fitch et al. | 299/4 |
| 3,606,465 | 9/1971 | Hanson | 299/4 |
| 3,713,698 | 1/1973 | Rhoadis | 299/4 |
| 3,860,289 | 1/1975 | Learmont | 299/4 |
| 3,863,987 | 2/1975 | Lampard | 299/4 |
| 3,915,499 | 10/1975 | Mallon et al. | 299/4 |
| 3,937,520 | 2/1976 | Sivert | 299/4 |
| 4,066,297 | 1/1978 | Spence | 299/4 |
| 4,079,783 | 3/1978 | Snavely et al. | 299/4 |
| 4,082,358 | 4/1978 | Learmont | 299/4 |
| 4,082,359 | 4/1978 | Spence | 299/4 |
| 4,083,603 | 4/1978 | Stover | 299/4 |
| 4,085,971 | 4/1978 | Jacoby | 299/4 |
| 4,105,252 | 8/1978 | Moore | 299/4 |
| 4,105,253 | 8/1978 | Showaller | 299/4 |
| 4,108,722 | 8/1978 | Stover | 299/4 |
| 4,114,693 | 9/1978 | Foster et al. | 299/4 |
| 4,134,618 | 1/1979 | Kossack | 299/4 |
| 4,155,982 | 5/1979 | Hunkin et al. | 299/4 |
| 4,185,872 | 1/1980 | Habib, Jr. | 299/4 |
| 4,234,231 | 11/1980 | Yan | 299/4 |
| 4,260,193 | 4/1981 | Stover | 299/5 |
| 4,278,292 | 7/1981 | Yan et al. | 299/5 |
| 4,314,779 | 2/1982 | Sundar | 299/4 |

*Primary Examiner*—William F. Pate, III

*Attorney, Agent, or Firm*—Cates & Roediger

[57] ABSTRACT

A method of solution mining wherein a lixiviant containing both leaching and oxidizing agents is injected into the subsurface orebody. The composition of the lixiviant is changed by reducing the level of oxidizing agent to zero so that soluble species continue to be removed from the subsurface environment. This reduces the uranium level of the ground water acquifier after termination of the lixiviant injection.

6 Claims, No Drawings

METHOD OF SOLUTION MINING SUBSURFACE OREBODIES TO REDUCE RESTORATION ACTIVITIES

BACKGROUND OF THE INVENTION

The present invention relates to the recovery of ore from subsurface orebodies by solution mining and, more particularly, to insitu leaching operations wherein the orebody is subjected to the action of a solubilizing agent in order to permit economic extraction of the ore.

At present, solution mining of subsurface orebodies is primarily being utilized to extract uranium values from small orebodies. The attractiveness of the insitu operations is due to a number of factors including lower capital investment, elimination of hazards peculiar to underground mining operations and the substantial reduction in surface and subsidence reclamation costs. As a result, insitu mining by the injection of solutions has permitted the economic exploitation of smaller orebodies.

While all subsurface orebodies are not well-suited for solution mining techniques, successful extraction of ore values has taken place where the subsurface orebody is characterized by an orebody contained within a porous host formation saturated with water and vertically bounded by relatively impermeable strata to provide a confined underground environment. In addition, the host formation should be sufficiently permeable to permit the solutions injected into the formation to flow therethrough Although a number of different techniques and well patterns are used, solution mining utilizes one or more injection wells and one or more recovery wells spaced therefrom with a hydrostatic gradient created therebetween.

Further, the chemical nature of the orebody and the host formation have to be evaluated to determine the type of solubilizing agent and leaching agent needed in the lixiviant to permit the recovery of sufficient ore values to make the endeavor economically feasible. As the lixiviant travels through the host formation, the solubilizing agent, typically an oxidizer, converts the tetravalent uranium to hexavalent uranium. The leaching agent dissolves the hexavalent uranium allowing it to be mobilized and the pregnant solution is then removed from the recovery well for further processing.

Prior activity has been directed to the evaluation of different leaching agents including sulfuric acid, sodium carbonate-bicarbonate solutions and ammonium carbonate-bicarbonate solutions. In addition, hydrogen peroxide, oxygen and different hypochlorates and sulfates have been utilized as the oxidizing agents in a number of applications. The selection of agents typically is made after extensive testing of the orebody and host formation. The agent selection is very important since the ore values are quite low and in order to achieve an economically successful mining operation it is necessary that as much of the ore as practical be exposed to the action of the lixiviant.

In the exposure of the bulk of the orebody to the lixiviant, substantial quantities of contaminants, both minerals and salts, are also contacted by and may be dissolved in the lixiviant. While these contaminants can be separated from the recovered pregnant solution by surface recovery installations, significant quantities of soluble contaminants have remained within the host formation. Typically, the host formation is an aquifer and the ground water contained therein is more than likely found to be contaminated to the point wherein higher than normal concentrations of some ions, particularly uranium ions, exist upon the cessation of solution mining.

It has been shown that a reduction in the level of contaminants in the ground water can be obtained by continued pumping of fluids from the host formation after cessation of the injection of the lixiviant provided adequate water recharge is available. However, this technique alone normally does not restore the ground water to an environmentally acceptable level due to the continued presence of undissolved soluble contaminants throughout surrounding regions of the host formation. These soluble contaminants, notably the uranium, continue to dissolve over a long period of time thereby maintaining the contaminant level of the water at an undesirably high level. The practice of continued pumping also is undesirable in that very large volumes of water may be required for restoration in critical water-limited regions of the United States.

To alleviate these problems it has been proposed that the pumped fluids be restored on the surface and then reinjected. The cycle is repeated with recirculation of a large number of complete pore volumes of the affected portion of the host formation for long periods. As an alternative, U.S. Pat. No. 4,134,618 describes the beneficial effects of cycling clean water through the host formation in order to restore the groundwater to acceptable levels.

The above-mentioned restoration techniques utilize substantial periods of pumping activity interleaved with long shut-in periods. This directly increases the cost of extraction by increasing the time and effort required for post-treatment. Also, the number of pore volumes of fluid required to be recirculated during post-extraction treatment has a direct bearing on the economics of the mining operation. In order to mine small subsurface orebodies, it is clearly desired to both decrease the volume of fluid that must be recirculated and to reduce the duration of the active and shut-in portions of the restoration treatment.

SUMMARY OF THE INVENTION

The present invention is directed to a reduction in the post-recovery activities needed to restore the subsurface environment and, in particular, to restore the groundwater and its host aquifer to an acceptable state. This and other objectives of the invention are accomplished by introducing the lixiviant containing a oxidizing agent and a leaching agent into the orebody to produce the pregnant solution for recovery and treatment at the surface and then reducing the concentration of oxidizing agent in the injected lixiviant to the zero level.

By substantially eliminating the oxidizing agent from the injected lixiviant after an initial period, the leaching action continues thereafter. This permits further recovery in the pregnant solution of the heretofore solubilized ore and contaminants from within the orebody and regions spaced adjacent thereto. The concentration of oxidizing agent in the injected lixiviant is reduced when the monitoring of the pregnant solution indicates that the concentration of ore in the solution has started to significantly decrease. Then, continued injection of a lixiviant containing primarily leaching agent causes the solubilized ore and contaminants to continue to be leached and dissolved in the recovered solution. However, the conversion of subsurface materials to soluble species diminishes while the lixiviant continues to leach the soluble matter from the subsurface environment.

The monitoring of the pregnant solution serves to indicate when the lixiviant composition should be changed. While the concentration of ore in the recovered solution is one indicator of the extent of soluble matter remaining in the subsurface environment, local conditions may point to the monitoring of other substances as the desired marker or indicator. Upon cessation of the injection of the lixiviant, an aqueous restoration fluid is then injected into the underground environment.

Further features and advantages of the invention will become more readily apparent from the following detailed description of a specific embodiment of the invention.

DETAILED DESCRIPTION OF THE INVENTION

In the extraction of uranium values from a subsurface orebody, the uranium ore is subjected to the chemical action of a lixiviant which typically contains an oxidizing agent and a leaching agent. The oxidizing agent is utilized to convert the uranium to a soluble form and the leaching agent effects the separation of the soluble material from the insoluble matter in the region subjected to the lixiviant. The solution mining process utilizes injection wells through which the lixiviant solution is pumped and production wells spaced therefrom. The pregnant solution is pumped from the production wells and supplied to the surface recovery installation. Well known processing techniques such as ion exchange columns are employed to effect the separation of the recovered uranium values from the pregnant solution. A large number of injection, recovery and ore separation techniques are well known in the solution mining industry and are described in the literature.

The lixiviant introduced into the subsurface region containing the orebody may be either acidic or alkaline in nature depending on the nature of the host formation. It includes a suitable oxidant for conversion of tetravalent uranium to the hexavalent state or for the retention of the uranium in the hexavalent state. The nature of the orebody and its underground environment is such that other ionic species may be rendered soluble thereby and are dissolved during the extraction process. This is due to the composition of the host formation and the surrounding layers. In practice, both the host formation and the surrounding layers have variable permeabilities so that the flow path of the lixiviant varies as it extends between injection and recovery wells. As a result, a variety of species in the subsurface environment are often rendered soluble and enter solution.

A significant quantity of the additional soluble species, including the hexavalent uranium, remain insitu during the extraction process and continue to dissolve in the groundwater in the event that steps are not taken to remove these contaminants and restore the groundwater environment at the conclusion of the extraction process. Several different approaches to the restoration of the groundwater environment have been taken including continuing to pump water from the aquifer and disposing of it while utilizing the groundwater recharge mechanism as a water supply. This technique requires the disposal of large amounts of contaminated water and is characterized by a relatively long post-extractive operating period. The total amount of water removal necessary varies based on the nature of the host formation, the surrounding layers, the lixiviant and the extent of the subsurface dispersion. Thus, it may be difficult to determine the extent of the restorative pumping necessary in advance of solution mining.

As an alternative, the contaminated water removed upon the cessation of lixiviant injection and the final recovery of the pregnant solution can be subjected to conventional water purification processes. Typically, the chloride and alkaline metal ions are stripped from the water by ion exchange resins and sulfate ions can be precipitated out of and removed from the water prior to reinjection into the underground host formation. The purification requires extensive operating facilities and adds significantly to the operating costs thereby reducing the cost effectiveness of solution mining in low grade subsurface uranium mining.

It has been found that the present method reduces the post-mining restoration activities needed to insure that the groundwater is restored to environmentally acceptable levels. This is accomplished by modifying the composition of the lixiviant during the recovery phase of mining by the substantial elimination of the oxidizing agent while continuing to inject the leaching agent into the subsurface environment. Thus, the solubilization or oxidation reaction of the uranium is allowed to extinguish by successive reduction of the oxidant to a zero level. The reduction of the level of oxidant in the lixiviant is initiated when the concentration of the uranium in the pregnant solution indicates that the expected economic limit of recovery has been reached. Since the injection of the leaching agent continues, soluble uranium and other species continue to be leached from the orebody and recovered from solution until the value of the uranium or other monitored substance present in the solution reaches a relatively low concentration level, typically that of the baseline or original concentration of the aquifer.

In the practice of the present invention wherein experimentation has demonstrated the ability of this method to effectively restore the aquifer to the initial or baseline conditions, a staggered line-drive wellfield pattern of injection, production and monitoring wells typical of the pattern known in the industry was utilized. The lixiviant employed contained a sodium carbonate-bicarbonate mixture as the leaching agent and oxygen was used as the solubilizing agent. The recovered pregnant solution was continually circulated through a processing plant containing ion exchange columns wherein the uranium ($U_3O_8$) is recovered prior to reinjection into the orebody. A variety of methods of uranium recovery from the solution are well known in the industry and are not considered a part of the present invention.

After months of solution mining, the head grade of the uranium ($U_3O_8$) at the processing plant had begun to decrease significantly to what was previously determined by calculation to be near the economic lower limit for this mining operation. At that point in time, the level of oxidant in the lixiviant was successively reduced to a zero level thereby substantially extinguishing the oxidation reaction of the uranium. In this experimental use of the present method, the composition of the lixiviant was varied based on the monitored uranium head values present in the feed to the recovery installation. The following table shows the reduction in oxidant with a reduction in ore recovery as expressed in the head grade to the plant.

| URANIUM HEAD GRADE % ($U_3O_8$) | OXIDIZING AGENT % ($O_2$) | OXIDIZING TIME PERIOD | LEACHING AGENT % ($CO_3/HCO_3$) |
|---|---|---|---|
| 100 | 100 | 10 weeks | 100 |
| 100 | 75 | 4 days | 100 |
| 77 | 50 | 6 days | 100 |
| 68 | 25 | 6 days | 100 |
| 60 | 0 | 10 days | 100 |
| less than 5 | 0 | | 100 |

It should be noted that in the above data, the 100% figure for uranium indicates the uranium head value at the initiation of the present method and not the maximum value of $U_3O_8$ in the pregnant solution. The corresponding reductions in oxidizing agent in the lixiviant are similarly shown. The leaching agent is maintained at essentially 100% of its initial value until termination of the lixiviant injection.

The lixiviant injection containing the leaching agent was continued until the value of the uranium in the feed to the recovery plant was reduced to near zero. In this case, the uranium value was less than 5% of the value at the time of initiation of the method. During the practice of the method, the pregnant solution was continually subjected to the ion exchange recovery system for uranium and reinjected. In practice, the injection and recovery wells may be alternated if desired.

At the termination of the injection of the leaching agent-rich lixiviant, the last pore volume of the spent wellfield is pumped to the next field to be mined. Preferably, the fluid is withdrawn from the inner wells of the spent wellfield and injected into the inner wells of the virgin field. At the same time, the outer wells of the virgin field are pumped and the water injected into the outer wells of the spent wellfield. This procedure saves process reagents and futher reduces the need for surface storage of contaminated water.

In the experimental testing of the method, the baseline values of the ground water were measured prior to the initiation of mining with about 4 data points taken for each item of interest. In this mining environment, critical chemical species were identified and monitored for determining when the restoration of the ground water had taken place. The values of the species prior to and subsequent to mining and to restoration activity are set forth below:

| SPECIE | BASELINE MEAN VALUE | POST-MINING VALUE | FINAL RESTORATION VALUE |
|---|---|---|---|
| Sulfate | 996 | 1320 | 379 |
| Uranium | 0.001 | <1 | <1 |
| Specific conductivity (Micromhos/CM) | 1602 | 4400 | 1192 |
| Chloride | 31 | 500 | 68 |
| Sodium | 472 | 1000 | 379 |
| Calcium | 34 | 120 | 47 |
| Bicarbonate | 61 | 910 | 293 |

(all values are milligrams per liter unless otherwise noted).

The foregoing results show that reduction in uranium concentration for the restoration of the groundwater aquifer is accomplished with the present method of reducing the level of the oxidizing agent in the lixiviant to zero while continuing to inject the leaching agent-rich lixiviant and to recover uranium therefrom. In the experimental application described, the number of pore volumes of lixiviant with no added oxidizing agent injected and recovered was three. A fourth pore volume was withdrawn and injected into a new field with ground water recharge utilized to fill the reservoir. Seven additional pore volumes were recirculated in this field and treated by reverse osmosis to lower the chloride, sodium, calcium and bicarbonate specie values for the final restoration. These figures will vary with different applications of the method.

The continued leaching in the absence of significant solubilization reduces the amount of soluble species in the host formation and surrounding zones thereby providing a stable environment at the completion of the method. The migration of uranium and heavy metal ions after termination of the mineral recovery phase of mining is reduced since the solubilization of species is no longer taking place during the final stages of leaching. Remaining contaminants in the pregnant solution can be removed by reverse osmosis technology with the brine held in an evaporation pond. The concentrated solids remaining after evaporation are readily disposed of by conventional techniques as approved by the appropriate environmental agencies.

While the prior description has referred to a specific embodiment of the invention, it is recognized that modifications and variations may be made therein according to the particular mining environment encountered without departing from the scope of the invention as claimed.

I claim:

1. A method of solution mining for the insitu extraction of ore located in an aqueous subsurface environment wherein partial restoration of the subsurface environment takes place during mining, said method comprising the steps of:
   (a) introducing a lixiviant into the subsurface environment to produce a pregnant solution, said lixiviant comprising an oxidizing agent and a leaching agent;
   (b) recovering the pregnant solution from the subsurface environment;
   (c) substantially reducing the concentration of the oxidizing agent in the lixiviant while continuing to introduce lixiviant into the subsurface environment and to recover the pregnant solution therefrom;
   (d) further continuing the introduction of the lixiviant containing the leaching agent for an interval sufficient to effect a substantial reduction in concentration of substances affected by the presence of the oxidant in said lixiviant; and
   (e) terminating the introduction of the lixiviant into the subsurface environment.

2. The method of claim 1 wherein the concentration of the oxidizing agent in said lixiviant is reduced during mining so as to be substantially eliminated from said lixiviant as the lixiviant continues to be introduced into the subsurface environment during mining.

3. The method of claim 2 wherein the concentration of the oxidizing agent of said lixiviant is sequentially reduced to zero while said lixiviant continues to be introduced into the subsurface environment during mining.

4. The method of claim 3 further comprising the step of monitoring the composition of the recovered pregnant solution prior to the step of terminating the introduction of the lixiviant into the subsurface environment.

5. The method of claim 4 further comprising the step of monitoring the ore content of said pregnant solution while reducing the concentration of the oxidizing agent in the lixiviant to zero.

6. The method of claim 5 further comprising the step of recirculating the lixiviant through the orebody after eliminating the oxidizing agent therefrom.

* * * * *